US005893696A

United States Patent [19]

Belinsky

[11] Patent Number: 5,893,696

[45] Date of Patent: Apr. 13, 1999

[54] HIGH-RISE AUTOMATED GARAGE

[76] Inventor: Sidney I. Belinsky, 40 Waterside Plz. Apt. 14A, New York, N.Y. 10010

[21] Appl. No.: 09/000,512

[22] Filed: Dec. 30, 1997

[51] Int. Cl.[6] ..... E04H 6/22

[52] U.S. Cl. ..... 414/255; 414/264; 414/253; 414/259

[58] Field of Search ..... 414/253, 255, 414/259, 260, 252, 264, 659, 660, 261, 281, 282, 273, 227, 231, 800, 808, 814

[56] References Cited

U.S. PATENT DOCUMENTS

| | | | |
|---|---|---|---|
| 5,018,926 | 5/1991 | Sternad | 414/255 X |
| 5,267,822 | 12/1993 | Paravia et al. | 414/264 X |
| 5,320,473 | 6/1994 | Arnold et al. | 414/253 |
| 5,437,536 | 8/1995 | Bianca | 414/253 X |

FOREIGN PATENT DOCUMENTS

| | | | |
|---|---|---|---|
| 592664 | 2/1960 | Canada | 414/255 |
| 831636 | 3/1960 | United Kingdom | 414/259 |

*Primary Examiner*—Frank E. Werner

[57] ABSTRACT

A High-rise Automated Garage (HAG) for offstreet parking consists of up to 40 stories (levels) car storage structure and a bank of elevators in the middle of this structure. Elevators are oriented along the garage and can pick-up cars from a flat driveway along the garage. Car handling carriages of the elevators can lift cars as cargo, using their wheels as the pick-up points, and move them horizontally into elevator's platform. In the case of one elevator failure, cars parked in the zone served by this elevator can be relocated by attendants into the zone served by an operating elevator, thus providing the capability of returning cars to the owners in a reasonable time. HAG has two loading (unloading) lanes. This allows an increase in the driver time for arriving and releasing the car to two elevators' cycles.

5 Claims, 12 Drawing Sheets

HIGH-RISE AUTOMATED GARAGE

FIELD OF INVENTION

This invention relates to the storage of motor vehicles or the like and particularly to multi-stories automated parking garages.

BACKGROUND—RELATED APPLICATION

Application Ser. No.—08/734,743, filed Oct. 21, 1996, now abandoned

Application Ser. No.—08/504,067, filed Jul. 19, 1995, now abandoned

Inventor of both—Sidney I. Belinsky

Title of both—High-rise Automated Garage

BACKGROUND—DISCUSSION OF PRIOR ART

Multi-stories garages are of two kinds:—ramp type and mechanical type with elevators. The main advantages of ramp type garages: high degree of reliability and high throughput capacity. Their main drawbacks: not suitable for small parcels of land and their height is restricted to up to 6 stories from the entrance level, due to human factor, thus limiting their land utilization.

The main advantages of mechanical garages: they can be placed on small parcels of land and their height can be up to 40 stories, thus improving the land utilization. Their main drawbacks: low degree of reliability, low throughput capacity and higher maintenance cost.

Since mechanical garages started 50 years ago, there has been competition with ramp type garages and various types of mechanical garages have been introduced to the world-wide market, and many of them have failed. Presently on the market are two types of garages. They are: garages handling cars on pallets and garages handling cars through their wheels. These types of garages survived the competition due to their ability to improve the land utilization by increasing their height from 10 stories to about 40 stories.

This drastic improvement became possible due to substitution of moveable elevators by a stationary elevator. The significant weight and inertia of moveable elevators are the main reason for their height limitations. The stationary elevators do not have the weight and inertia problem and their limitation of up to 40 stories is based on operational factors. The increase in the garage height proportionally increases the land utilization per parking stall. In many cases this is a decisive factor for choosing the type of a garage for a particular application.

However there is a price to pay for this advantage. Garages utilizing moveable elevators have at least two of them. This allows, in case one of them fails, to continue garage operation with a slower throughput capacity. A garage utilizing one or several stationary elevators can not substitute a failed elevator by any other elevator; as the result the car located in the zone of the failed elevator could be returned to customers only after damage of the elevator's systems has been repaired and operation restored. This process might require many hours or even days.

For purposes of demonstration, we compare the innovative features of the garage of the instant invention with the widely used high-rise pigeon-hole mechanical type garage, which handles cars through their wheels.

OBJECTS AND ADVANTAGES

The main object of this invention is to overcome the main drawbacks of the known high-rise mechanical garages handling cars through their wheels by providing them with throughput capacity and with the degree of reliability comparable with the ramp type garages, in the sense of returning parked cars to the customers in a reasonable time in case of equipment failure.

DESCRIPTION OF INVENTION

Figure 1:
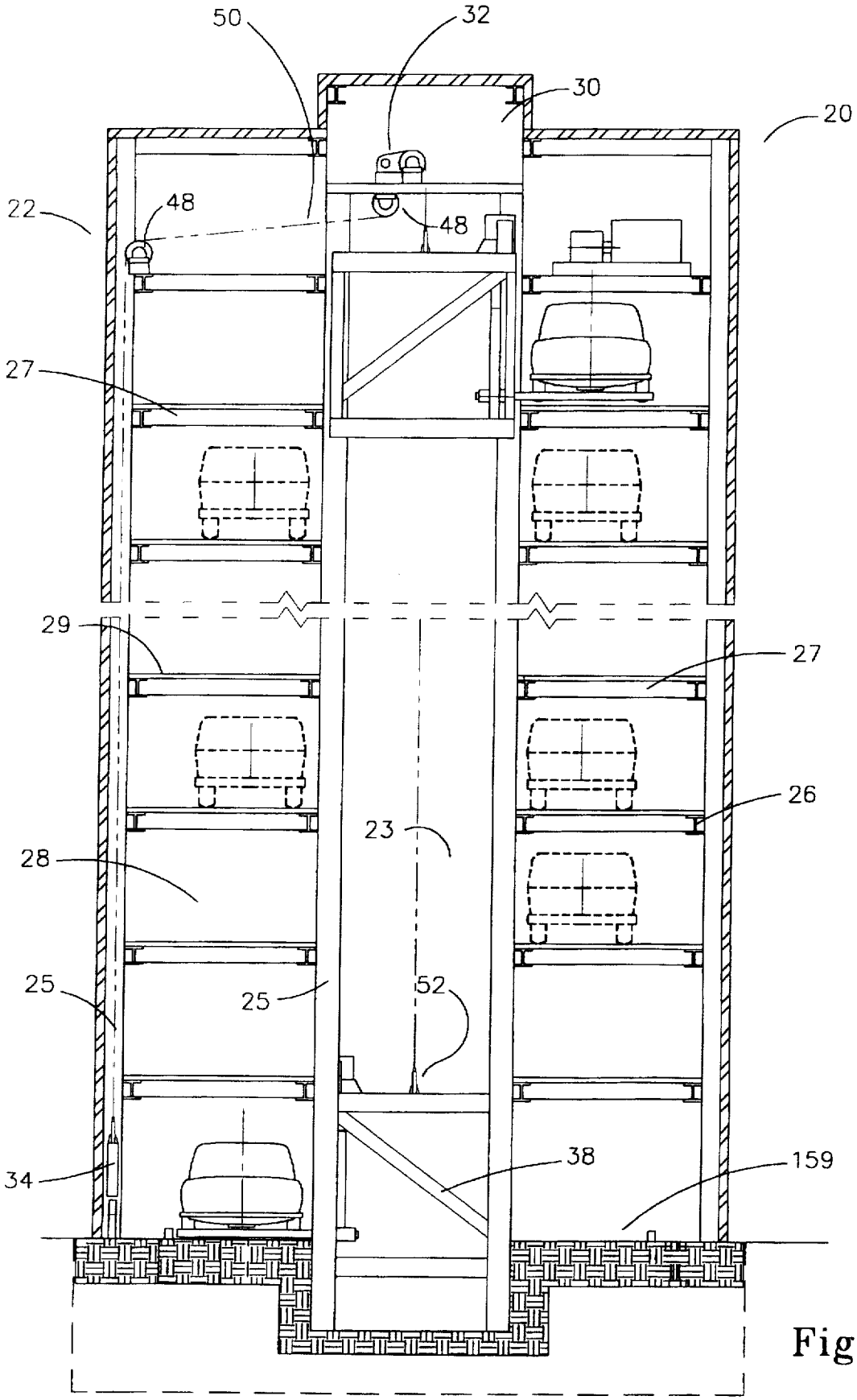
FIG. 1—A Cross Section.
Figure 2:
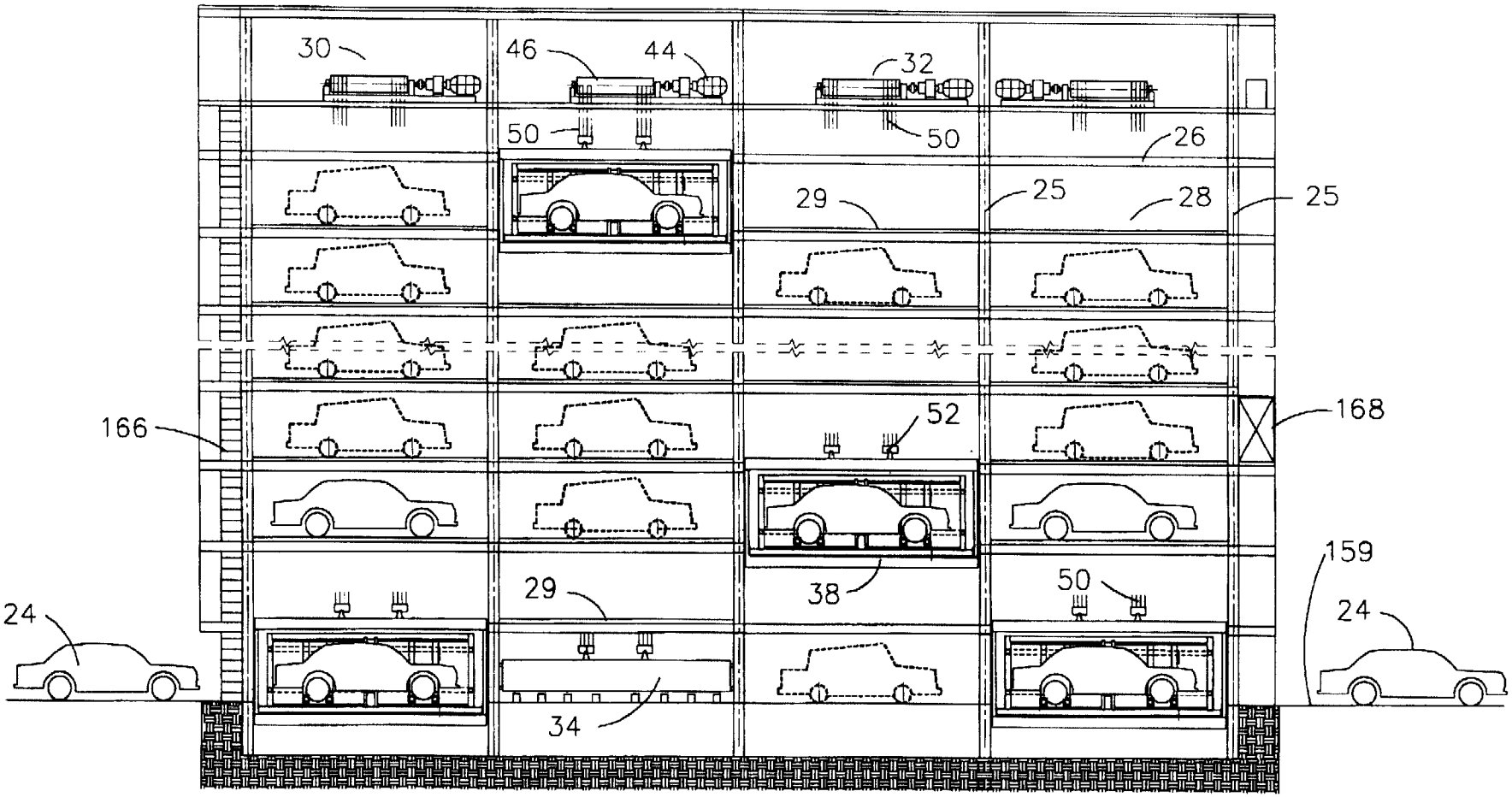
FIG. 2—A Longitudinal Section.
Figure 3:
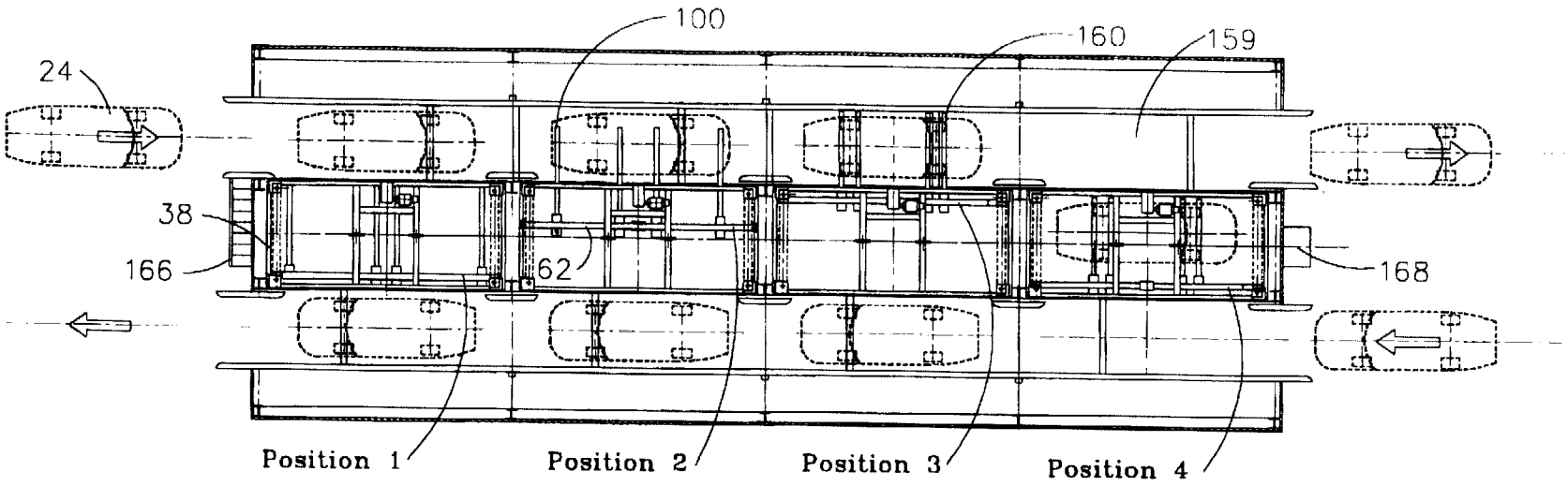
FIG. 3—A Plan of an operating level.
Figure 4:
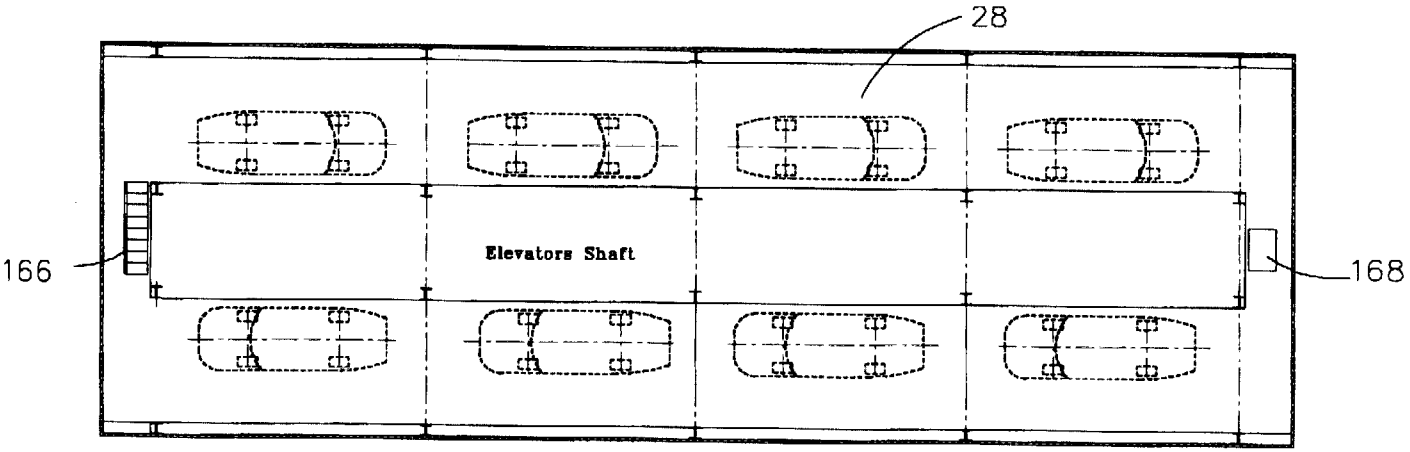
FIG. 4—A Plan of a storage level.
Figure 5:
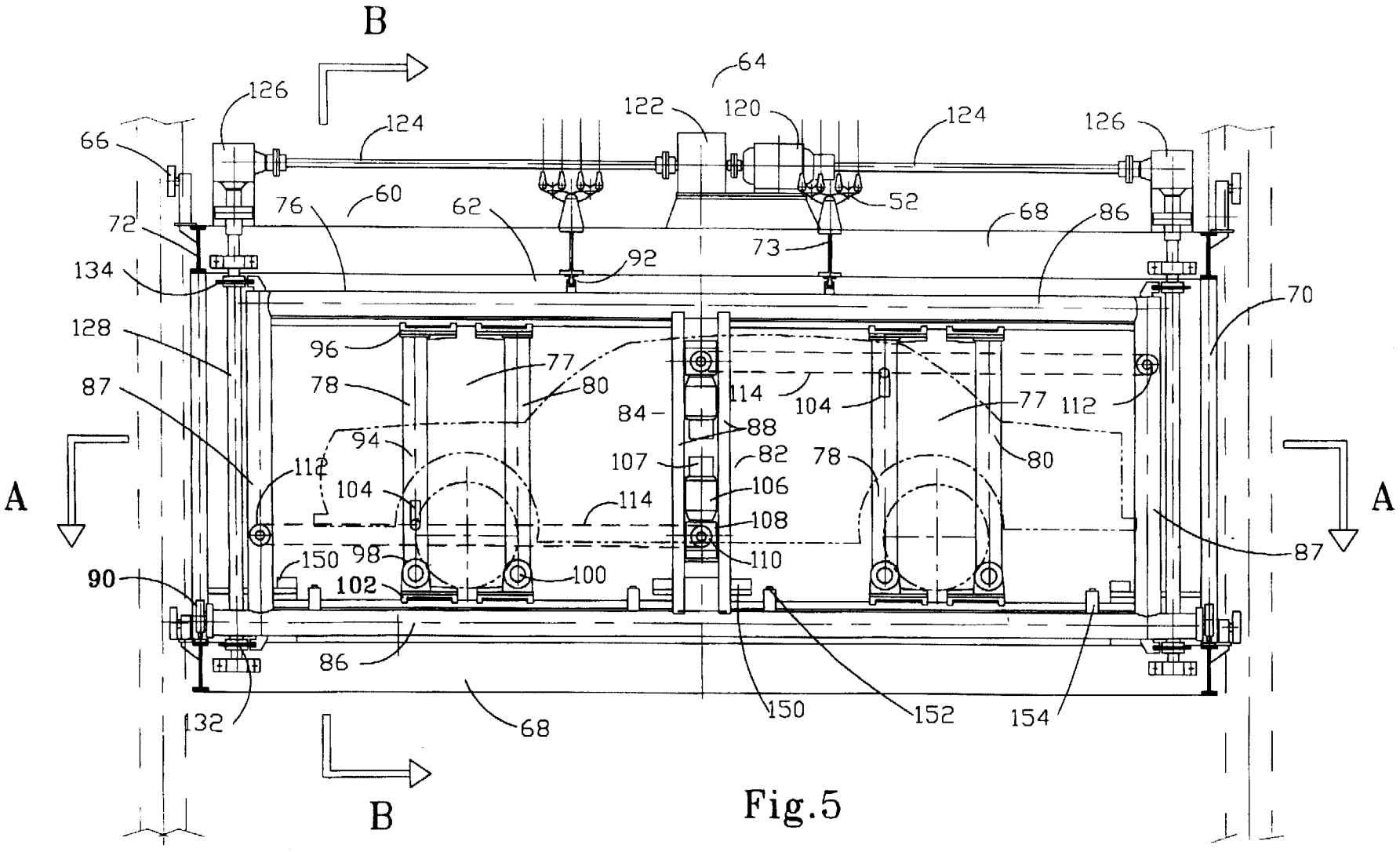
FIG. 5—An Elevator Platform Elevation.
Figure 6:
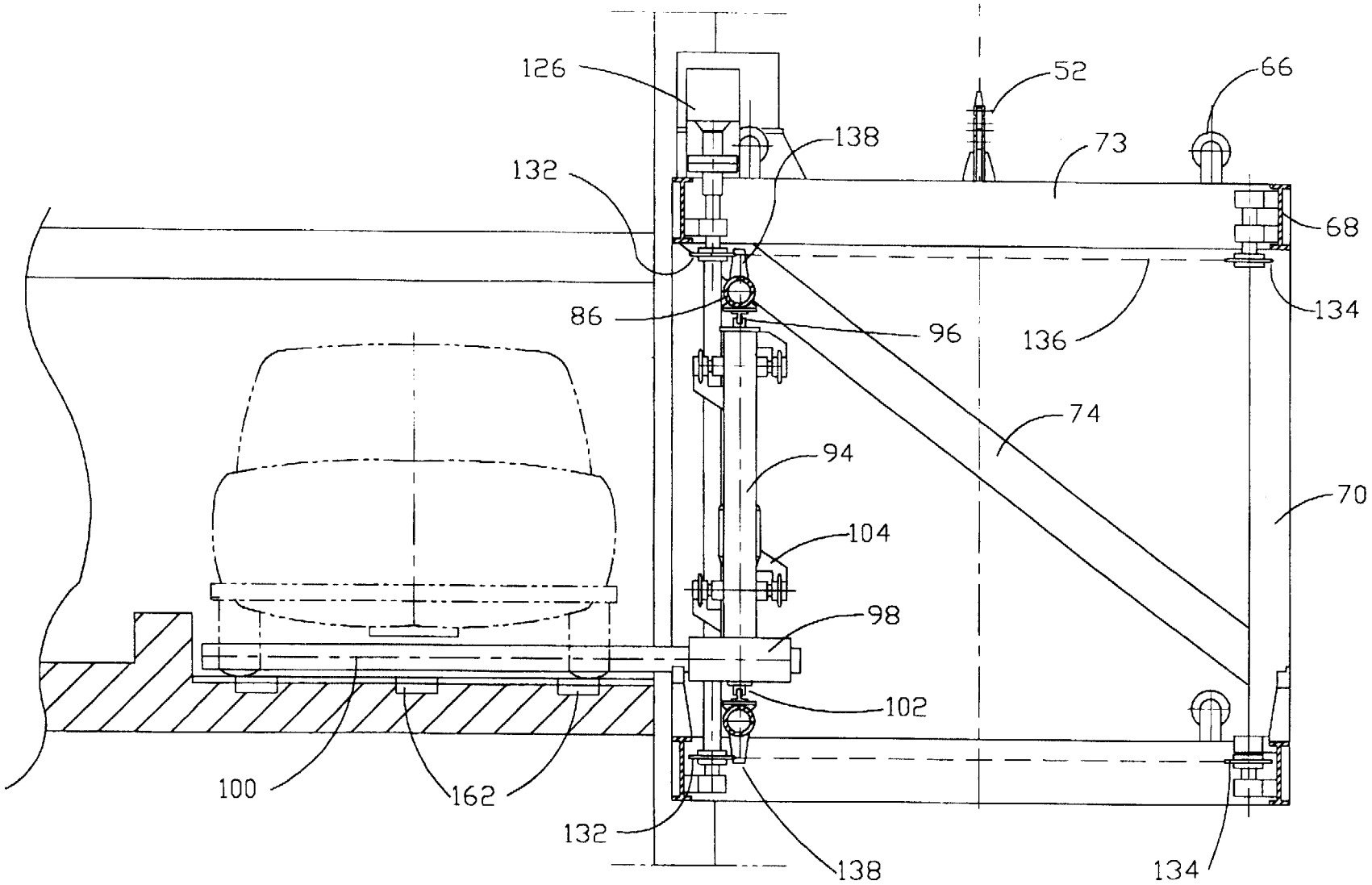
FIG. 6—An Elevator Platform (section B—B from FIG. 5).
Figure 7:
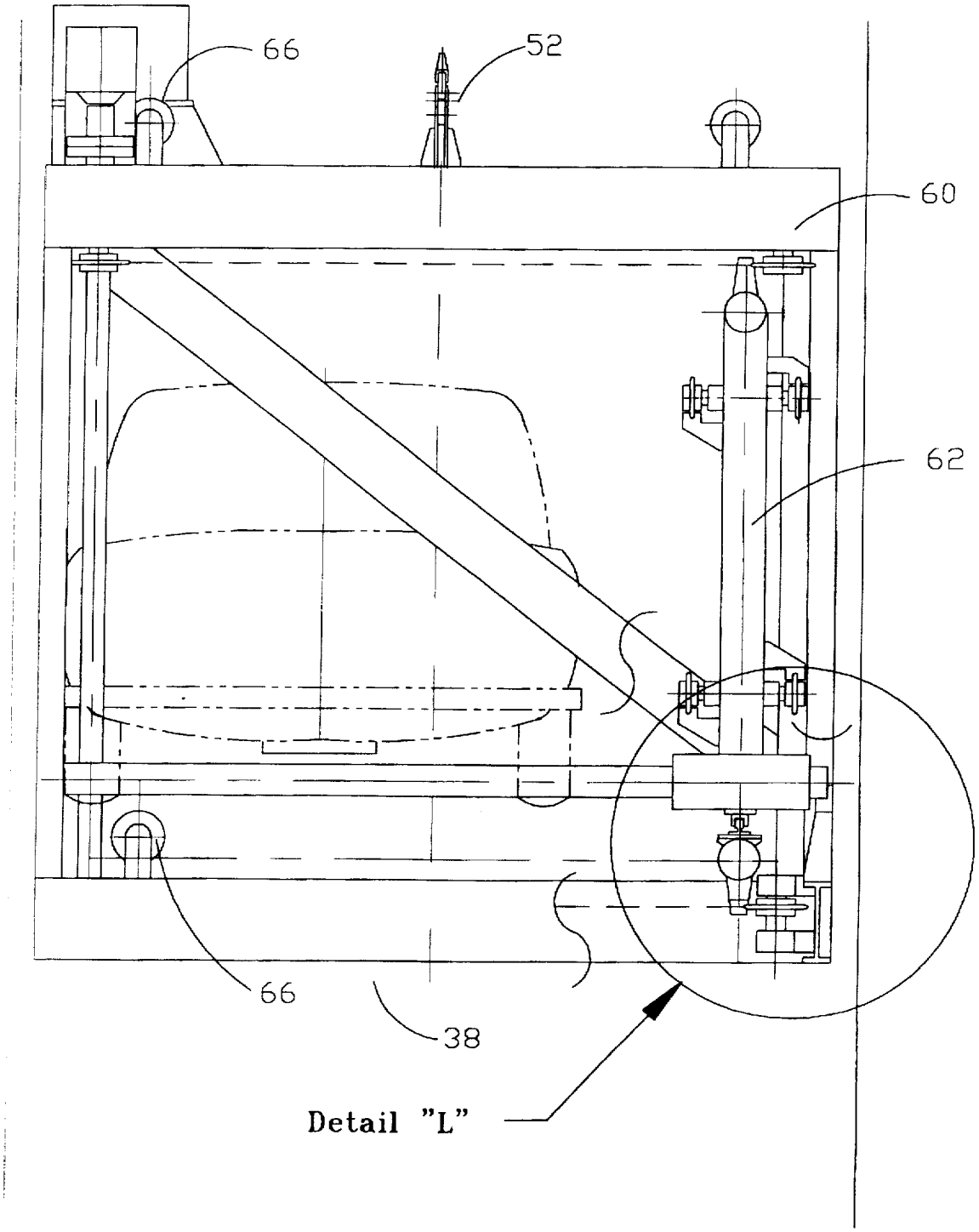
FIG. 7—An Elevator Platform (side view with car inside).

FIGS. 1, 2, 3 and 4 illustrates the High-rise Automated Garage (HAG) 20, consisting of two towers 21 and 22 and an elevator shaft 23 between them. Arriving cars 24 are approaching towers 21 and 22 from opposite sides. Cars depart towers 21 and 22 from the opposite side they entered.

Each tower consists of the vertical columns 25, the horizontal longitudinal beams 26 and the cross beams 27. On each level there are four stalls 28, each consisting of a flat panels 29 and supports formed by longitudinal beams 26 and cross beam 27.

Two elevator systems 30 are shown in their upper position, one in a lower position and one in an intermediate position. Each system includes a hoisting drive 32, counterweight 34, vertical guide rails 36 and elevator platform 38. Hoisting drive 32 consists of motor 44, traction drum 46, two sets of guiding sheaves 48, hoisting lines 50, hoisting lines suspension arrangements 52.

FIGS. 5 through 11 illustrate the design of the elevator platform 38.

Elevator platform 38 consists of a frame 60, a car handling carriage 62, a car handling carriage drive 64 and a side guide roller assembly 66.

The frame 60 is a box with open sides formed by four longitudinal beams 68, four vertical beams 70 and four cross beams 72. Two upper cross beams 73 serve as supports for the hoisting lines suspension arrangements 52 and for guide rails 74.

Car handling carriage 62 consists of a frame 76, two wheel-grabber systems 77, for engaging the front and rear wheels of parking car, each consisting of a pair of sliding-columns 78 and 80 and their drives 82 and 84.

The frame 76 is a panel of two upper and lower horizontal beams 86, two outer vertical beams 87 and two inner vertical beams 88. Two support rollers 90 are attached to the lower horizontal beam 86. Two sliders 92 are attached to the upper horizontal beam 86 and are engaged with guide rails 74.

Each of sliding-columns 78 and 80 consists of a vertical column 94, an upper longitudinally oriented slider 96 attached to the top end of column 95, a lower athwart oriented bushing 98 attached to the lower end of column 94, a wheel-engager 100 placed inside the bushing 98, a lower longitudinally oriented slider 102 and a dog 104 through which the sliding-columns are moved by drives 82 and 84 through chain-loops 114.

Each of the drives 82 and 84 of the sliding-columns 78 and 80 consists of a motor 105, a brake 106, a torque limiter 107, a differential gear box 108, two powered sprockets 110, two chains 114 and 116 and two idle sprocket assemblies 112.

A car handling carriage drive 64 consists of a motor 120, a gear box 122 having two output shafts, two transmission shafts 124 and two 90° gear boxes 126. It also includes two vertical shafts 128, connected to gear boxes 126, two pair of chain arrangements 129 and 130, each consisting of powered sprocket 132 and idle sprocket arrangement 134, chain 136 and dog 138.

One of the car handling carriage drive 64 functions is to reverse orientation of the wheel-engager 100, required to handle cars located on floors of the opposite tower. For this purpose the frame 60 of elevator platform incorporates eight supports-stoppers 150 with their base 152. These support-stoppers arrest the wheel-engagers 100 in their utmost outreach position (see FIG. 8 and FIG. 10 through FIG. 12) and enables the drive 64 to move the entire car handling carriage 62 from one side of the elevator platform to the other side sliding along the arrested wheel-engager 100. Frame 60 also incorporates eight limit-stoppers 154 with solenoid actuators 156. The purpose of these limit-stopper 154 is to stop movement of the sliding-columns 78 and 80 as soon as their wheel-engager 100 is out of contact with supports-stoppers 150.

Elevator platform 38 incorporates four side guide roller assemblies 66 to prevent it from tilting by a significant angle when a car is lifted from the stall floor. This tilting is expected due to normal gaps between the guiding rollers and the rails.

The operating level of the HAG has wheel grooves 160. These grooves are used to fix the position of the car's front wheels always in the same spot. It includes pressure sensors 162 to provide information to a central control station.

Figure 13:
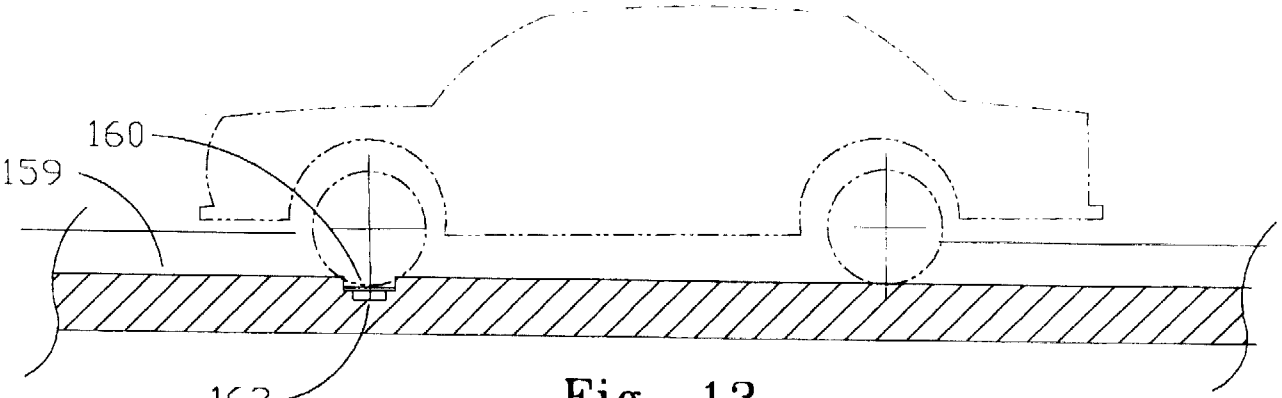
FIG. 13—A Section D—D from FIG. 16.
Figure 9:
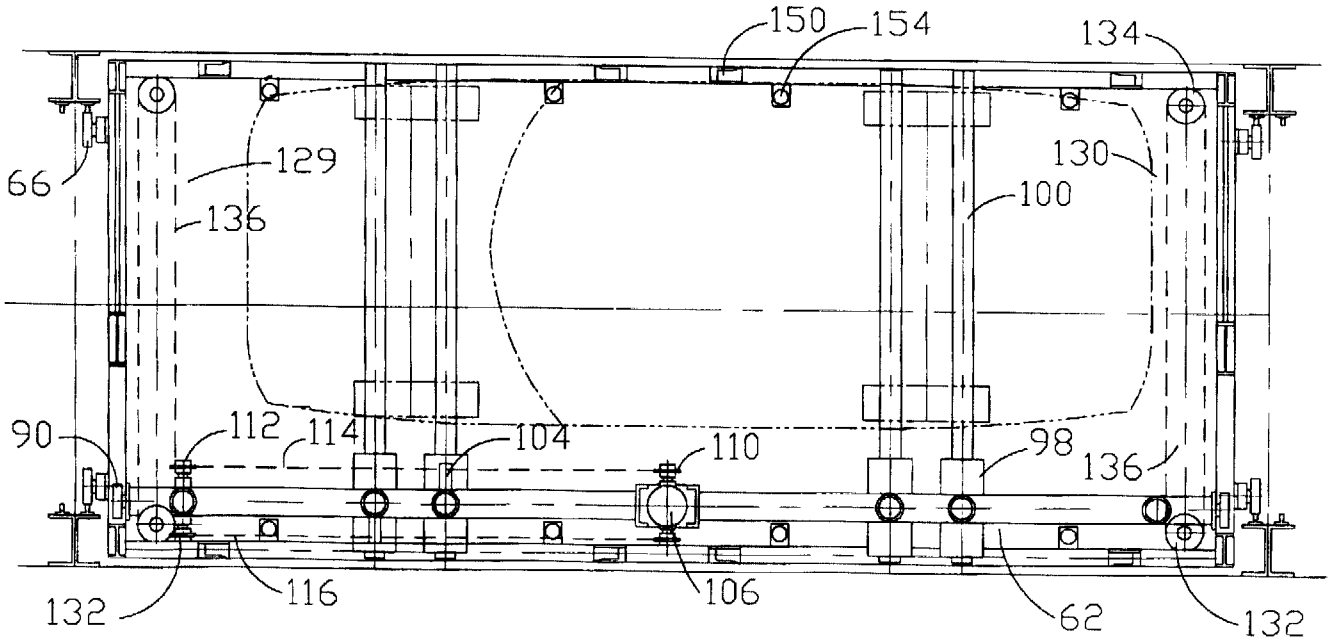
FIG. 9—An Elevator Platform (section A—A from FIG. 5).
Figure 10:
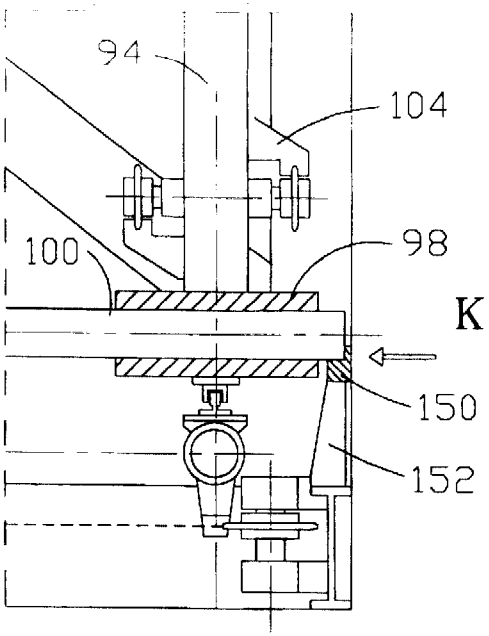
FIG. 10—A Detail "L" from FIG. 7.
Figure 11:
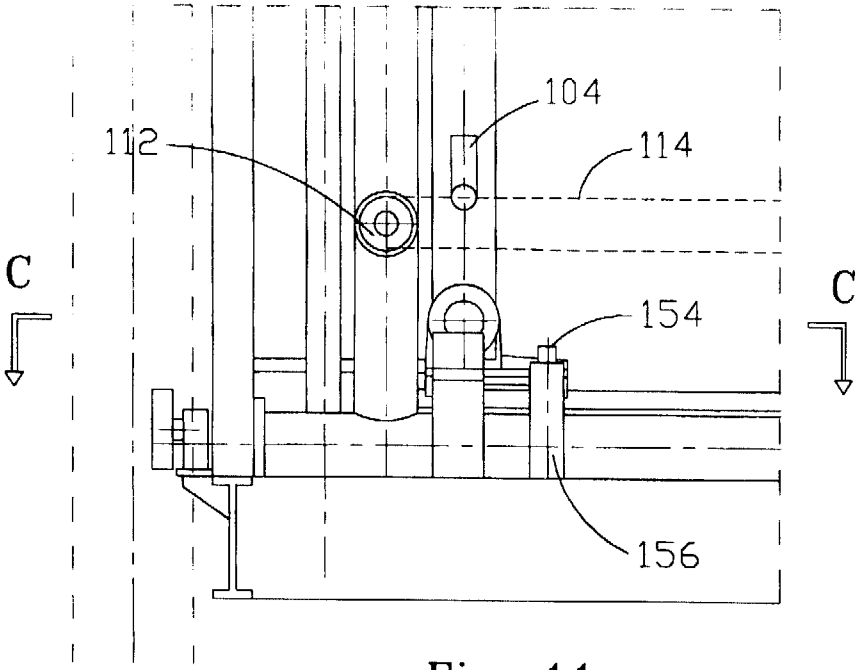
FIG. 11—A View "K" from FIG. 10.
Figure 12:
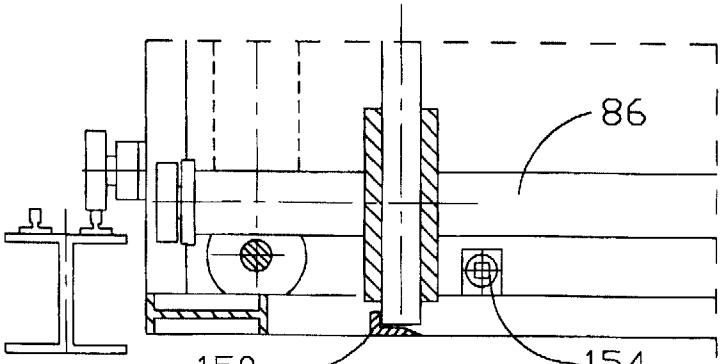
FIG. 12—A Section C—C from FIG. 11.
Figure 14:
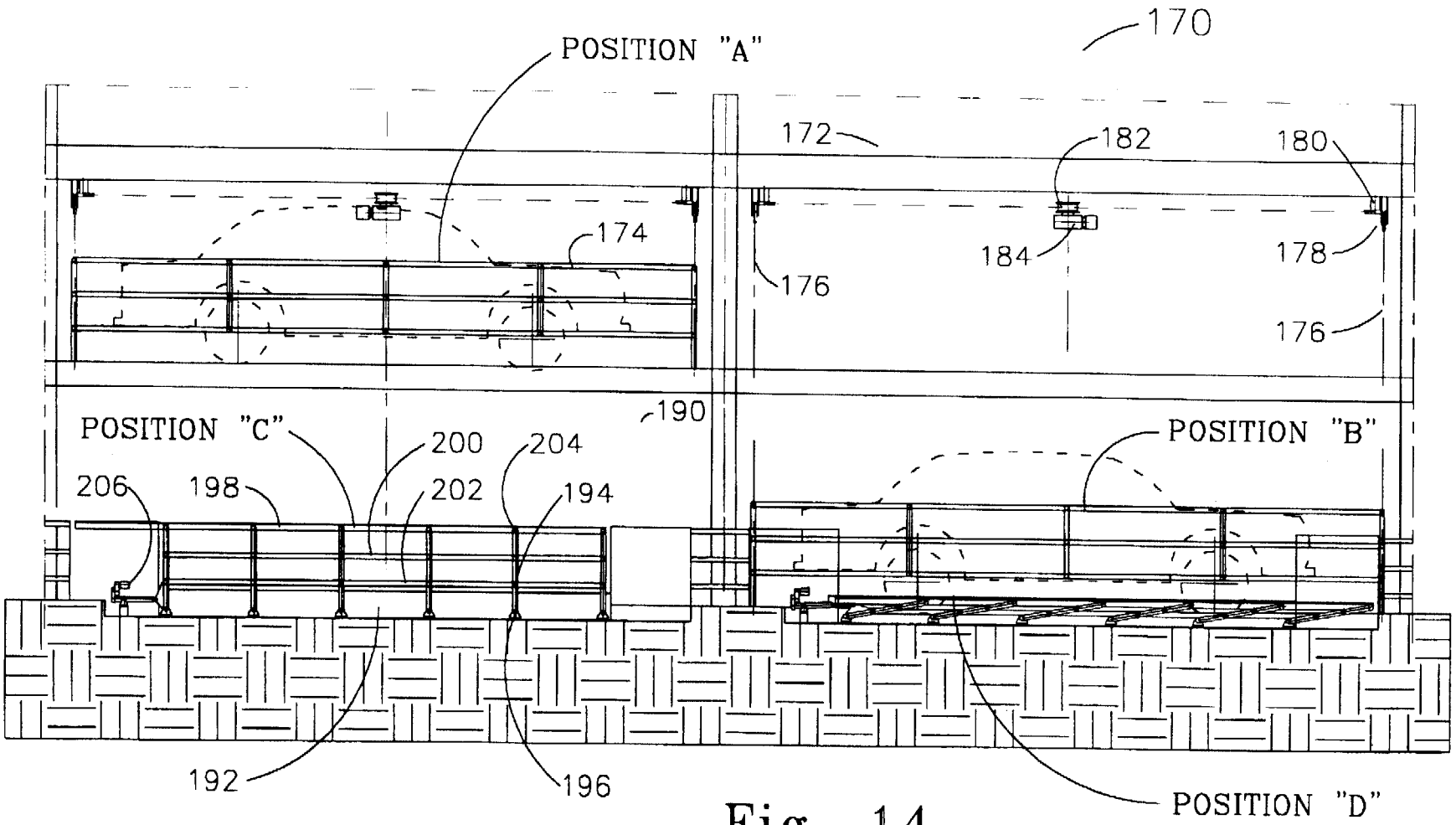
FIG. 14—A Section illustrating railing system.
Figure 15:
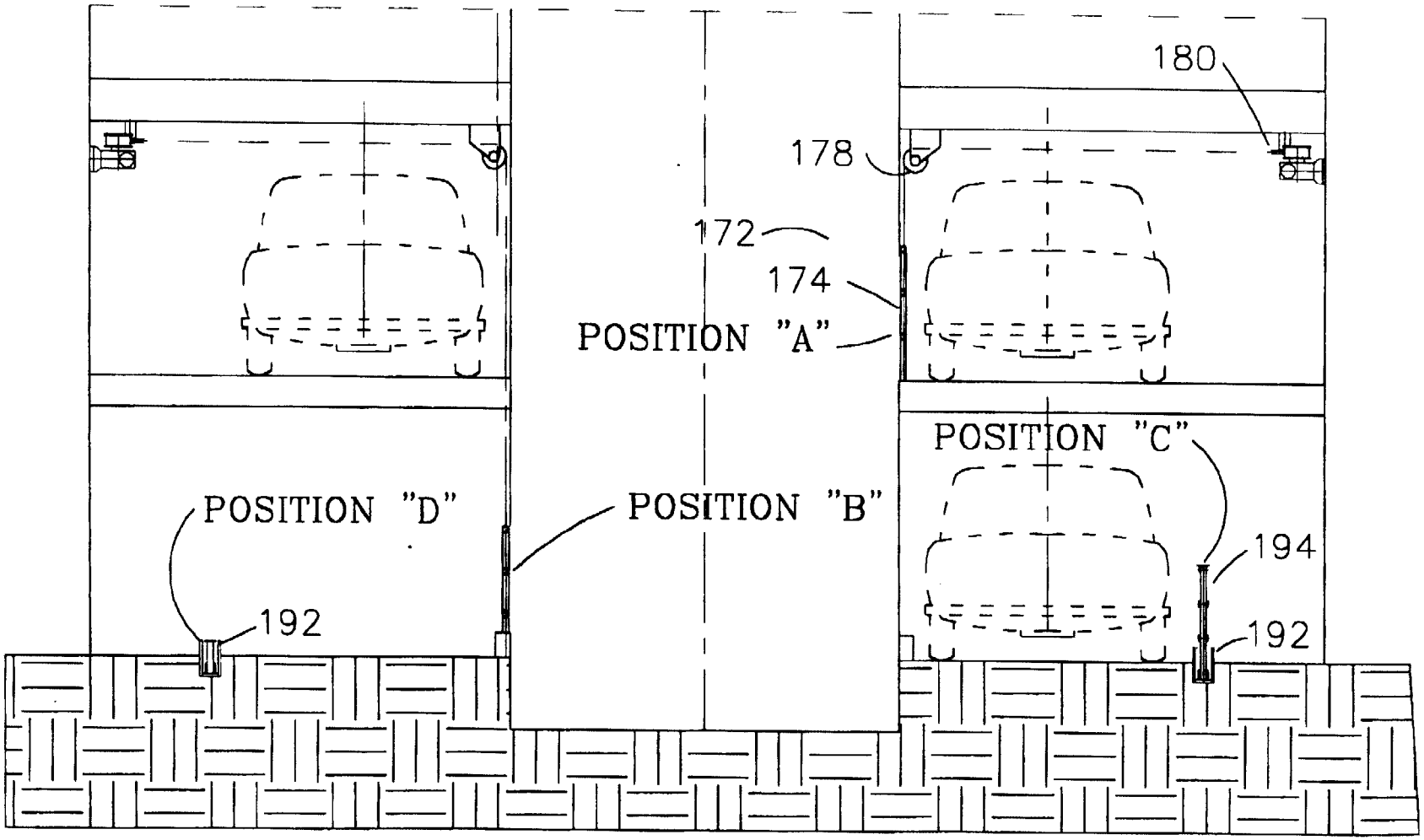
FIG. 15—A Elevation illustrating railing system.
Figure 16:
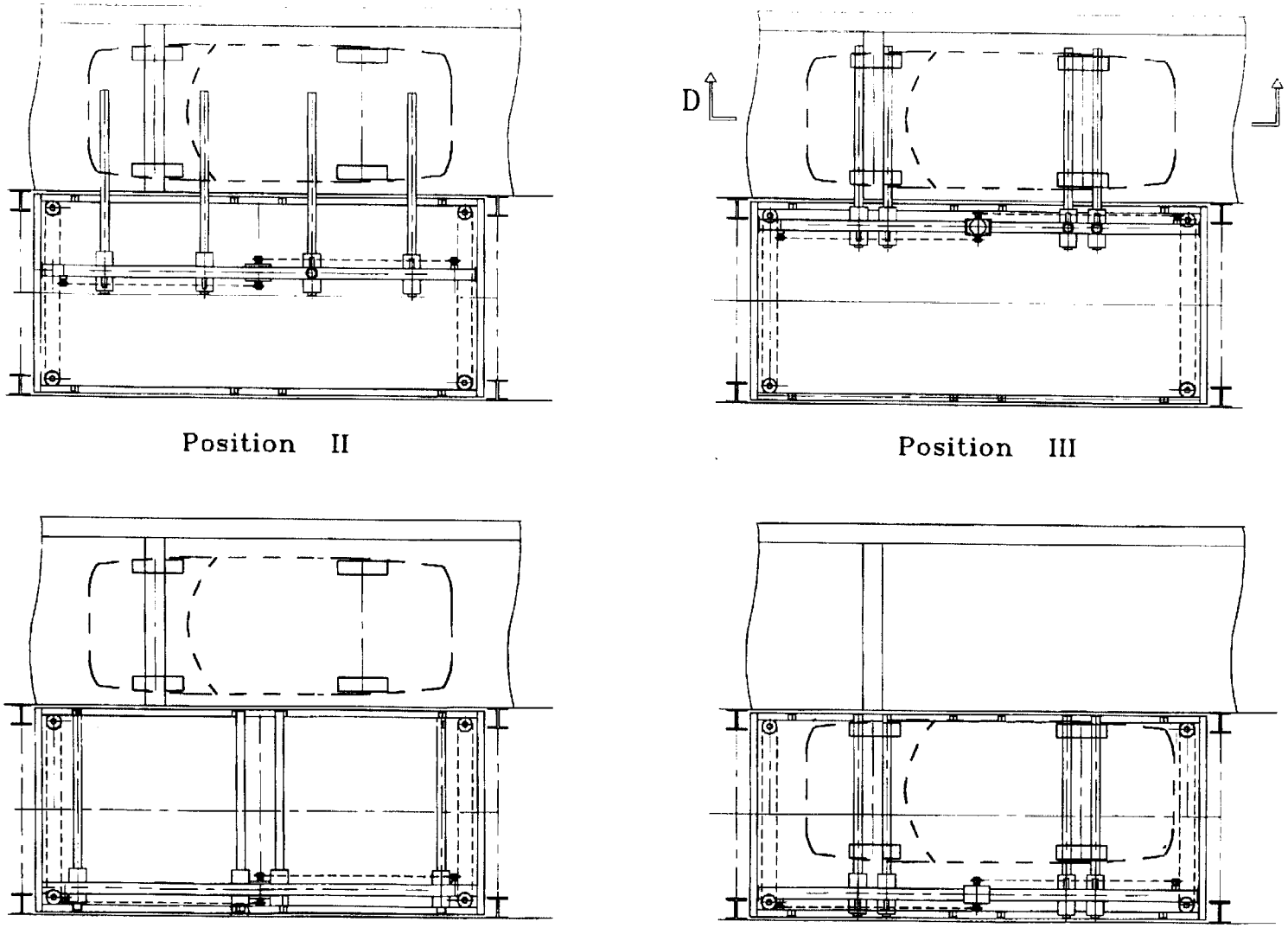
FIG. 16—A Diagram illustrating process of engaging with a car.

The HAG structure has on one side stairs 166 and on the other side personnel elevator 168. The FIGS. 13 and 14 illustrate means 170, located in each stall on the operating level 159, for preventing drivers and their passengers acting as pedestrians from interference with moving cars and elevator platforms.

System 172, which prevents pedestrians from moving into elevator shaft, consists of vertically sliding rigid frame 174, suspended on two hoisting lines 176, connected through the guiding sheaves 178 and 180 to the drum 182 of a winch 184. Position "A" shows frame 174 lifted, which is required when car is moved in or out from the stall. Position "B" shows frame 174 lowered and serving as a barrier for entering the elevator shaft.

System 190, which prevents pedestrians from interference with moving cars, consists of a base 192, in form of an elongated channel, several stanchions 194, each having a base 196 on which it can pivot, an upper horizontal bar 198 and two intermediate horizontal bars 200 and 202. These horizontal bars are connected with stanchions 194 by a pivot pins 204.

One of the stanchions 194 is connected with a push-pull drive 206. Position "C" shows stanchions 194 in an up-right position, thus forming a barrier for pedestrians to step on the road for cars. Position "D" shows stanchions 194 pivoted to a degree at which the all horizontal bars 198, 200 and 202 are fitted into base-channel 192, thus permitting the driver to enter or depart from the car.

OPERATION OF INVENTION

Loading Mode

During loading operation the cars 25 will arrive, by batches of 4, to the operating level. The first car entering garage moves to the end of an operating lane until its wheels are positioned in the last wheel groove. The following cars stop after reaching the last available wheel groove. After all drivers leave their cars and press control buttons, indicating that cars are ready for parking, all four elevator platforms 38 are descending to the operating level.

Inserting operation

Elevator platform 38 will stop at the height at which the bottom line of the wheel-engager 100 will be about one inch above the operating level. At this situation the car handling carriages 62 are in Position "I" (see FIGS. 3; 8 and 13) and the wheel-engagers 100 are in their ultimate outward position and locked between the support-stoppers 150.

Engagement Operation

Figure 8:
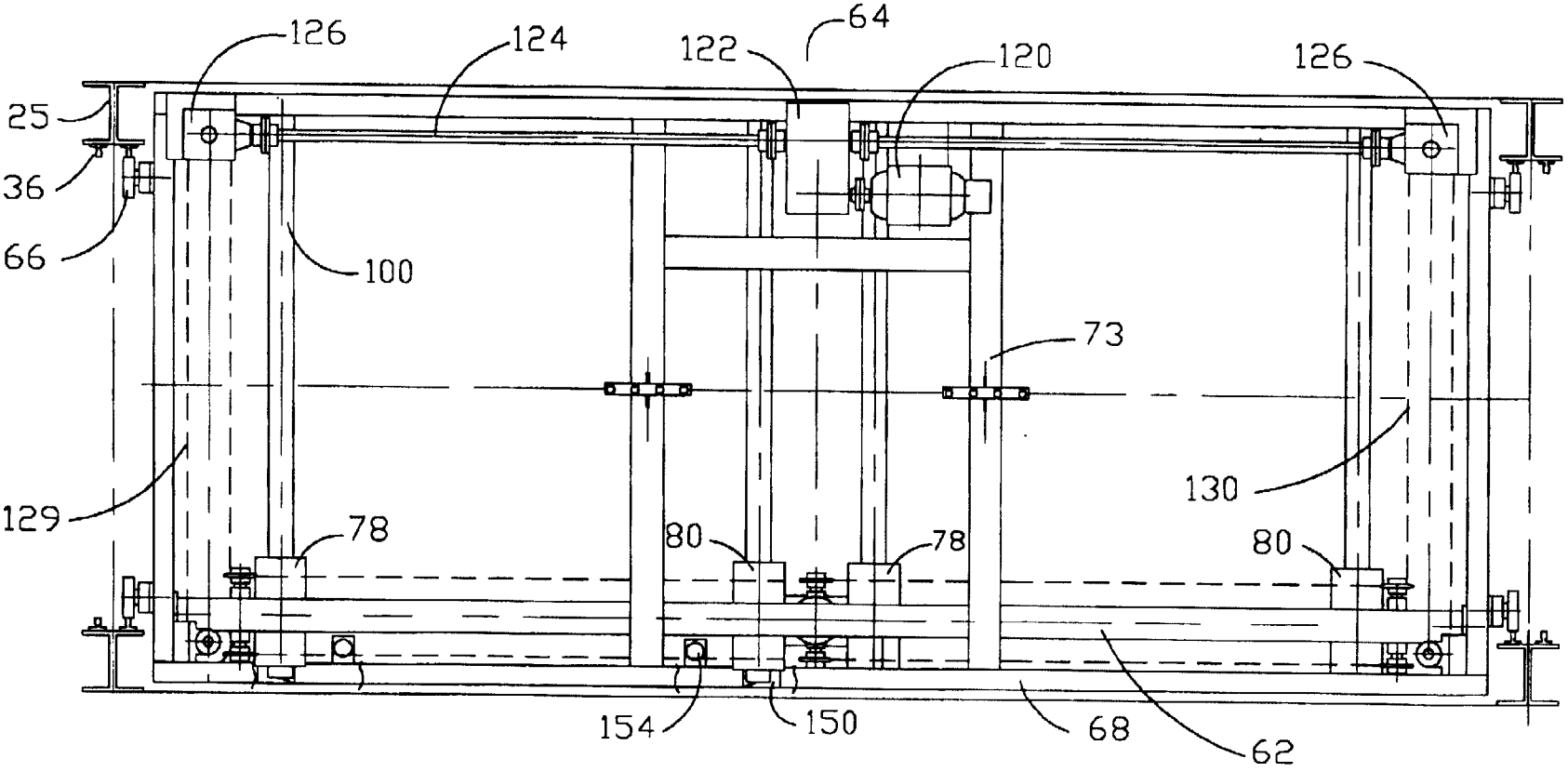
FIG. 8—An Elevator Platform (plan view).

At the first step of the process of engaging with the car wheels, the drives 82 and 84 pull the sliding-columns 78 and 80 from a position shown by FIG. 8 toward each other to an "initial position". This position is determined by a limit-stopper 154 and is a short distance travel, sufficient only for the wheel-engagers 100 to clear the support-stoppers 150. The limit-stoppers 154 are activated simultaneously with the drives 82 and 84, thus excluding the possibility that any of sliding-columns 78 and 80 would pass them.

At the next step the drive 64 puffs the car handling carriage 62 from the left extreme to the right extreme position (see lower position of elevator platform 38 at FIG. 1 and Positions II at FIG. 14). Simultaneously with the start of the drive 64 all solenoid actuators 154 will be deenergized and will be lowered into a stored position. After the car handling carriage 62 reaches its extreme position, the drives 82 and 84 start to move the sliding-columns 78 and 80 toward each other and by this action the wheel-engagers 100 will start to move toward the cars wheels. As soon as one of the wheel-engagers 100 come in contact with the wheel, movement will stop, but the other wheel-engager will continue its movement, due to the differential gear box 108, until it meets the same wheel. At this moment the motor 106 will develop a maximum torque under which the torque limiter 107 will stop it (see Position III, FIG. 14). After the engagement between the car 25 and car handling carriages 78 and 80 is completed the hoisting drive 32 lifts elevator platform 38 with the car 25 two inches. In this position the car handling carriage drive 64 pulls car handling carriage 62 with the car 25 on it inside the elevator platform 38.

Lifting Operation

After engagement process with the car 25 is completed the hoisting drives 32 start to lift all four elevator platforms almost simultaneously. Depending on the availability of the empty stalls the elevator platforms might stop at any of four different floors. All of them will be positioned in a manner that the bottom line of the wheel-engagers 100 will be a few inches above the corresponding floor.

Operation of the Insertion of a Car into a Stall

After the elevator platform 38 stops at the designated floor, the drive 64 of the car handling carriage 62 will move the car 25 inside the stall. At the end of the insertion stroke, the hoisting drive 32 will lower the elevator platform 38 until the full weight of the car 25 is transferred to the stall floor. After wheel-engagers 100 are released from the car 25, the drives 82 and 84 move sliding-columns 78 and 80 to their "initial position". As soon as this move is completed the drive 64 moves the car handling carriage 62 to its right extreme position.

Lowering Operation

Since the counterweight 34 weight exceeds the weight of an empty elevator platform 38, the process of lowering elevator platform is factually the process of lifting the counterweight 34.

Unloading mode

During this mode car owners will come to an operating level and will request their cars by inserting magnetic cards and typing in their PIN. According to their requests, each elevator platform 38 will move up to the stall where the owner's car is positioned. After the elevator platforms reach designated levels they will insert the wheel-engagers 100 into the stalls, engage them with the car's wheels, pull cars inside the elevator platforms, and lower and place them on operating level. All these steps will be done in the sequence described above in the loading mode of operation.

Departing Operation

Drivers board the cars and then drive them to the street in a sequence of one after the other.

Operation of handling cars located in opposite stalls

This operation is achieved by reversing orientation (from the left side to the right side) of the wheel-engagers 100 in relation to the car handling carriage 62.

This reversing will be accomplished by bringing wheel-engagers 100 to their ultimate outward position at which they are arrested between the support-stoppers 150 and by then moving the car handling carriage 62 from the left extreme position to the right extreme position. During this process the bushing 96 will slide over the wheel-engager 100, almost without friction, since wheel-engager will be supported from both ends by support-stoppers 150.

Emergency Mode

In case of one elevator failure, the cars parked in the zone served by this elevator will be moved by attendants to adjacent zones served by operating elevators. This will be achieved in the following manner. When a customer arrives to pick-up a car, which is parked in the zone of the failed elevator, he will give the car-key and magnetic card to an attendant. Utilizing the magnetic card the attendant will find out on which level and site the car is stored and will give an order to the computer controlling operation of the entire garage to empty one of the adjacent stalls in the zone of the operating elevators. Then he will go up to the car utilizing personnel elevator 164 or stairs 166. He will enter the car and move it to a free stall in front or behind it. After the car is placed in a zone of an operating elevator, the attendant goes back to an operating level and returns the car-key and magnetic card to the customer. From this moment, the customer request his car in the manner described above in Unloading Mode.

CONCLUSION AND SCOPE OF THE INVENTION

One of the main objects of this invention is to provide high-rise mechanical type garages, which handle cars through their wheels, with the degree of reliability comparable with ramp type garages. In this case, the reliability is understood as a capability of returning cars, in case of equipment or power failure, to customers in a reasonable time. The presently widely used pigeon-hole mechanical type garages, which handle cars through their wheels have the means of returning cars to customers in case of power failure, but lack the means of returning cars in case of equipment failure. The instant invention offers a solution to this problem.

The garage by the instant invention achieves its main goal by placing cars in the stall in a manner which permits their movement from a zone handling by one elevator to a zone handling by the other elevator.

The failure of one elevator in the instant invention means only a slow down rate of cars return. The failure of one of the elevators of the high-rise pigeon-hole mechanical garage means that cars located in the zone of this elevator will not be returned to customers until the failed systems are repaired. The required repairs might take many hours or even days. The garage by the instant invention places cars along the garage center line. In case of one elevator failure, the adjacent elevators can be used to return parked cars to the owners. For this purpose, part of the garage will be switched from an automated mode of operation to a manual mode. The attendant will get to the floor where the requested car is parked and will drive it to the available adjacent stall in the zone of an operating elevator. This operation can be done in a relatively short time, thus avoiding the main reason of a possible lawsuit.

In comparison, the high-rise pigeon-hole mechanical garages with stationary elevators, in case of one elevator failure can not move a car parked in the zone of a failed elevator to a zone where they could be handled by an operating elevator, which serves 6 pairs of stalls on each floor. The reason for this is that a high-rise pigeon-hole mechanical garage orients cars perpendicular to the garage center line and moves cars longitudinally, thus excluding the possibility of the car's lateral displacement, which is required to place it in the zone of the adjacent elevator.

Conclusion

The improvement in the reliability of the mechanical garages achieved is due to the innovative features of the instant invention allowing combined operation of several elevators in one garage and due to the capability of achieving the car manual movement in the longitudinal direction from one elevator to another.

The other main object of this invention is to provide mechanical type garages with the throughput capacity comparable with the ramp type garages.

This increase in throughput capacity is achieved through:

Reduction in the technical elevator lifting cycle by moving the cars laterally instead of moving them longitudinally.

Handling simultaneously 4 to 8 cars.

Utilization of two loading zones instead of one by the existing garages. This will allow the interval time between lifting (lowering) cars from one loading zone equal to two technical elevator cycles. This will provide the drivers with additional time to drive in, stop and release the car.

In comparison, the high-rise pigeon-hole mechanical garage has only one loading zone and can handle only two cars simultaneously. The factual elevator lifting cycle by high-rise pigeon-hole mechanical garage is longer, because a car is moved longitudinally, versus laterally by HAG and because of human factors involved.

Conclusion

The increase in the mechanical garages throughput capacity is achieved due to the innovative features of the instant invention allowing reduction in the elevator cycle and by an introduction of several loading (unloading) zones, which allow the exclusion of the human factor from the elevator lifting cycle.

Among other innovative features of the HAG is a railing system which prevents drivers and their passengers, when they act as the pedestrians, from interference with moving cars and elevator platforms.

While the above description contains many specificities, these should not be construed as limitations on the scope of invention, but rather as exemplification of one preferred embodiment thereof Many other variations are possible. Accordingly, the scope of the invention should be determined not by the embodiment illustrated, but by the appended claims and their legal equivalents.

What I claim is:

1. A high-rise automated garage for storing cars, said garage comprising:

two multi-level towers with open stalls, said towers each having an open side, said open sides facing each other and interconnected by a stationary elevator system, said stalls arranged on each level of said towers in a single longitudinal line;

said open stalls on an operating level having means for separating drivers and their passengers from moving cars and elevator platforms;

said stationary elevator system having plurality of stationary elevators, each elevator serving one stall on each level of each of said two towers, said stationary elevators comprising platforms which include car handling carriages, said platforms formed with beams as a rectangular box with open sides, said car handling carriages comprising:

a frame formed as two outer vertical beams, two inner vertical beams and upper and lower horizontal beams interconnecting said two inner vertical beams and said two outer vertical beams;

a pair of sliders attached to said upper horizontal beam;

a pair of support rollers attached to said lower horizontal beam;

a first wheel grabber system for grabbing front wheels of a parked car, and a second wheel grabber system for grabbing the rear wheels of the parked car, each of said wheel grabber systems including two sliding columns and means for moving said sliding columns simultaneously in a transverse direction, each sliding column having an upper longitudinal slider engaging said upper horizontal beam, a lower longitudinal slider engaging with said lower horizontal beam, an athwart oriented bushing, and a wheel-engager inside said bushing;

means for simultaneously changing the positions of said wheel-engagers with respect to all of said sliding columns, and means for moving the car handling carriage from one side of its respective platform to the other side of its platform.

2. A high-rise automated garage for storing cars, as recited in claim 1, wherein said means for moving said sliding columns in a transverse direction comprises:

an electric motor;

a torque limiter;

a differential gearbox with two output shafts and a power sprocket attached to each of said shafts;

two idle sprocket arrangements attached to said outer vertical column of said car handling carriage frame;

two chain loops connecting said idle sprocket arrangements with said power sprockets attached to said output shafts of said differential gearbox; and two dogs, each attached to one of said vertical columns, one connected to an upper line of one said chain loop and the other connected to the lower line of the other of said chain loops.

3. A high-rise automated garage for storing cars as recited in claim 1, wherein said means for simultaneously changing the position of said wheel-engager with respect to all of said sliding column comprises:

eight support-stoppers, attached to the lower beam of said elevator platform and serving as a support for said wheel-engagers when said sliding columns are in their extreme positions; and, eight limit-stoppers having solenoid actuators, said limit stoppers attached to said lower beams of said elevator platform in the vicinity of said sliding columns extreme positions of said sliding columns;

whereby engagement of said support-stoppers holds the wheel engagers in a fixed position as the means for moving the car handling carriage from one side of its platform to the other side of its platform is actuated, causing movement of said sliding-columns along said wheel engager in their fixed positions.

4. A high-rise automated garage for storing cars as recited in claim 1, wherein said means for moving the car handling carriage from one side of its respective platform to the other side of its platform comprises:

a motor with gear box having two output shafts, said output shafts located on the top of said frame of said elevator platform;

two 90° gear boxes;

two vertical shafts connected with said 90 degree gear boxes;

two powered sprockets attached to each of said vertical shaft;

two idle sprocket arrangements;

two chains engaged with said powered sprockets and said idle sprockets and connected to said frame of said car handling carriage; and two dogs, each attached to one of said vertical columns, one connected to an upper line of one said chain loop and other connected to a lower line of the other loop.

5. A high-rise automated garage for storing cars as recited in claim 1, wherein said open stalls on the operating level having means for separating drivers and their passenger from moving cars and elevator platforms comprises:

a vertically sliding railing having a rigid frame suspended on a pair of hoisting lines connected to a winch through a set of guiding sheaves;

an articulated railing having a base, in a form of an elongated channel also serving as a road curb;

a plurality of stanchions, each having a pivot base attached to said base;

one upper and two intermediate horizontal bars interconnected to said stanchions through pivot pins;

a powered drive connected to one of an outer said stanchion and enabling the pivoting of all said stanchions to a position by which all said horizontal bars can fit into said elongated channel, thus allowing the driver and its passengers access to a stopped car.

* * * * *